US009883754B1

(12) United States Patent
Leonardi

(10) Patent No.: US 9,883,754 B1
(45) Date of Patent: Feb. 6, 2018

(54) DISPLAY FOR CONSUMER ARTICLES

(71) Applicant: Timex Group USA, Inc., Middlebury, CT (US)

(72) Inventor: Silvio Leonardi, Milan (IT)

(73) Assignee: Timex Group USA, Inc., Middlebury, CT (US)

( * ) Notice: Subject to any disclaimer, the term of this patent is extended or adjusted under 35 U.S.C. 154(b) by 0 days.

(21) Appl. No.: 15/167,152

(22) Filed: May 27, 2016

(51) Int. Cl.

| | |
|---|---|
| ***A63F 9/08*** | (2006.01) |
| ***A47F 5/02*** | (2006.01) |
| ***A47F 7/02*** | (2006.01) |
| ***A47F 5/025*** | (2006.01) |

(52) U.S. Cl.
CPC ..... *A47F 5/02* (2013.01); *A47F 5/025* (2013.01); *A47F 7/02* (2013.01); *A47F 7/022* (2013.01); *A63F 9/0811* (2013.01)

(58) Field of Classification Search
CPC .... A47F 5/02; A47F 5/025; A47F 5/04; A47F 7/02; A47F 7/022; A47F 7/024; A45C 11/16
See application file for complete search history.

(56) References Cited

U.S. PATENT DOCUMENTS 1,172,107 A * 2/1916 Burton ..... B42D 15/00 235/74
1,410,342 A * 3/1922 Newell, Jr. ..... A61B 5/1176 273/155
1,865,923 A * 7/1932 Krawitz ..... A47F 5/025 108/20
2,071,338 A * 2/1937 Henze ..... A45D 44/005 132/53
3,469,708 A * 9/1969 Pennington ..... A47F 5/025 108/103
3,583,078 A * 6/1971 Burns ..... G09B 1/34 434/429
3,596,380 A * 8/1971 Williams ..... A44C 17/0258 273/155

(Continued)

OTHER PUBLICATIONS

"Industries Overview" http://www.datalizer.com/galleries/custom_solution_images/pop-point-of-sale.html, Admitted prior art.

(Continued)

*Primary Examiner* — Daniel J Troy
*Assistant Examiner* — Kimberley S Wright
(74) *Attorney, Agent, or Firm* — Carmody Torrance Sandak & Hennessey LLP

(57) ABSTRACT

A display for creating at least two differently configured articles, each of which comprises at least a first component and at least a second component. The display includes a first support on which at least two of the first components are arranged; a second support, spaced apart from the first support, on which at least one second component is arranged, and wherein the first support and the second support are rotatable with respect to each other; wherein the two components on the first support are each separately alignable, but not simultaneously, with the component on the second support thereby separately creating a visual impression of at least two substantially completed articles. A method of creating at least two differently configured articles, using the aforementioned display, is also provided.

8 Claims, 3 Drawing Sheets

(56) References Cited

U.S. PATENT DOCUMENTS 3,661,391 A * 5/1972 Henshaw ..... A63F 3/00214 273/241
3,717,942 A * 2/1973 Presby ..... G09B 17/00 273/155
4,094,409 A * 6/1978 Spranger ..... A47F 7/022 206/301
D271,778 S * 12/1983 Mabille ..... D18/10
4,650,077 A * 3/1987 Droz ..... A47F 7/022 206/480
4,986,426 A * 1/1991 Niklaus ..... A47F 7/022 211/85.2
5,286,026 A * 2/1994 Schnapp ..... A63F 9/0811 273/155
5,727,949 A * 3/1998 Bar-Or ..... G09F 11/23 40/491
5,788,232 A * 8/1998 Binkley ..... A63F 9/0811 273/153 S
D403,532 S * 1/1999 Moser ..... D6/682.2
6,139,325 A * 10/2000 Tracy ..... G09B 19/0023 356/423
6,334,530 B1 * 1/2002 Morris ..... A47F 7/02 206/566
8,434,250 B2 * 5/2013 Epp ..... G09F 5/042 40/495
8,499,940 B2 * 8/2013 Johnson ..... A47F 5/025 211/1.53
2003/0029768 A1 * 2/2003 Wong ..... A47F 5/02 206/526
2003/0145497 A1 * 8/2003 Leslie ..... G09F 11/23 40/495

OTHER PUBLICATIONS

"Custom Wheel Charts Formats" http://www.americanslidechart.com/wheel-charts. Admitted prior art.

* cited by examiner

DISPLAY FOR CONSUMER ARTICLES

BACKGROUND OF THE INVENTION

The present invention is directed to a display for creating at least substantially completed articles, wherein the articles are preferably consumer articles and in particular, timepieces, and in particular, to a rotateable display that permits a consumer to mix/match (i) a plurality of differing timepiece straps with at least one timepiece watchcase and/or (ii) a plurality of differing timepiece watchcases with at least one timepiece strap, thereby allowing a consumer to see what the at least essentially completed articles can and/or will look like prior to actual construction and/or purchase, thereby facilitating the buying, purchasing and/or shopping experience for such articles.

Selection wheels and wheel charts are known. For example, different types of such selection wheels and wheel charts can be found at http://www.americanslidechart.com/wheelcharts. A selection wheel that permits a potential customer to mix and match window colors with corresponding hardware colors is also known and illustrated in FIG. 4.

However, the prior art is deficient in the use, description and/or suggestion of a display that permits a potential customer/consumer or the like to create one or more differently configured at least substantially completed articles, and preferably consumer articles such as for example and not limitation, timepieces such as wristwatches. That is, nowhere in the prior art is there a display that facilities the creating of what a user can essentially perceive as a completed consumer article, thereby providing the consumer the ability to vary components of the article to see what variations of the components will look like when matched with other components, thereby improving the shopping and/or decision making experience of such articles.

Therefore, it is believed that further advances to the state of the art are both desirable and achievable. In particular, it is desirable to provide a way for easily and efficiently creating, in a display setting, a plurality of differently configured at least substantially completed articles, each of which comprises at least a first component and at least a second component. It is also desirable to provide a display that carries out the foregoing objectives.

It is thus an objective of the present invention to overcome the perceived deficiencies in the prior art.

Specifically, it is an objective of the present invention to provide an improved display for creating a plurality of differently configured at least substantially completed articles.

A further objective of the present invention is to provide an improved display as set forth above, wherein the articles are consumer articles, and preferably timepieces such as wristwatches.

Still a further objective of the present invention is to provide an improved display as set forth above utilizing at least two supports, one overlying the other, such that the relative rotation of the supports with respect to each other creates the visual impression of at least one, and preferably at least two, substantially completed articles.

Yet a further objective of the present invention is to provide a way for potential consumers to more easily and efficiently create a plurality of differently configured at least substantially completed consumer articles, thus improving and facilitating a shopping and/or potential purchase decision making experience.

Therefore, a still further objective of the present invention is to provide methodologies for carrying out and/or facilitating the foregoing.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

Therefore, to overcome the perceived deficiencies in the prior art and to achieve the objects and advantages set forth above and below, a preferred embodiment of the present invention is, generally speaking, directed to a display for creating at least two differently configured articles, each of which comprises at least a first component and at least a second component, wherein the display comprises a first support on which at least two of the first components are arranged; a second support, spaced apart from the first support, on which at least one second component is arranged, and wherein the first support and the second support are rotatable with respect to each other; wherein the two components on the first support are each separately alignable, but not simultaneously, with the component on the second support thereby separately creating a visual impression of at least two substantially completed articles.

In another preferred embodiment, the present invention is directed to a display for creating differently configured articles, wherein the display comprises a first support on which at least one component of the article is arranged; a second support, spaced apart from the first support, on which at least a second component of the article is arranged; wherein the first support is rotateable with respect to the second support to create a visual impression of at least one substantially completed article.

In yet another preferred embodiment, the present invention is directed to a method of creating at least two differently configured articles, each of which comprises at least a first component and at least a second component, wherein the display comprises a first support on is which at least two of the first components are arranged, a second support, spaced apart from the first support, on which at least one second component is arranged, and wherein the first support and the second support are rotatable with respect to each other, wherein the method comprises the steps of aligning the first component with the second component thereby creating at least a first visual impression of an least substantially completed article; and rotating the first support relative to the second support so as to align the second first component with the second component thereby creating at least a visual impression of at least a second at least substantially completed article; whereby the two components on the first support are each separately alignable, but not simultaneously, with the component on the second support.

In a specific pref erred embodiment, the display comprises no more than 12 first components and no more than 12 second components arranged about their respective supports, and in a specific preferred embodiment, the articles are timepieces in the form of wristwatches.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
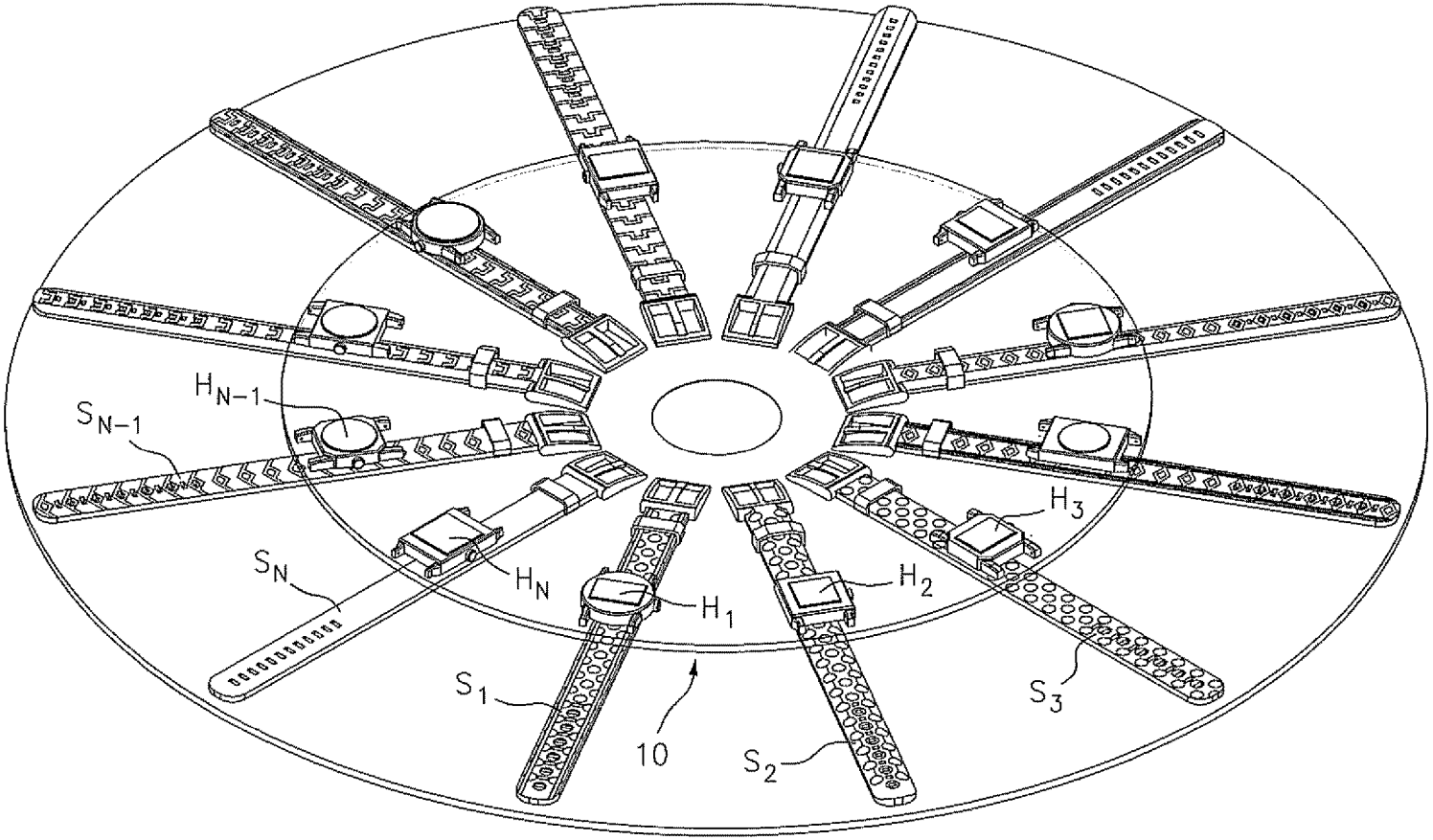
FIG. 1 is a perspective view of exemplary display constructed in accordance with the preferred embodiments disclosed herein.
Figure 2:
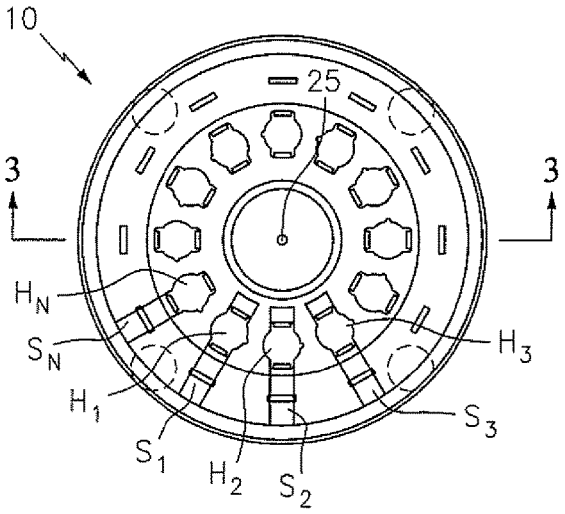
FIG. 2 is a top plan view of the display constructed in accordance with the preferred embodiment of FIG. 1.
Figure 3:
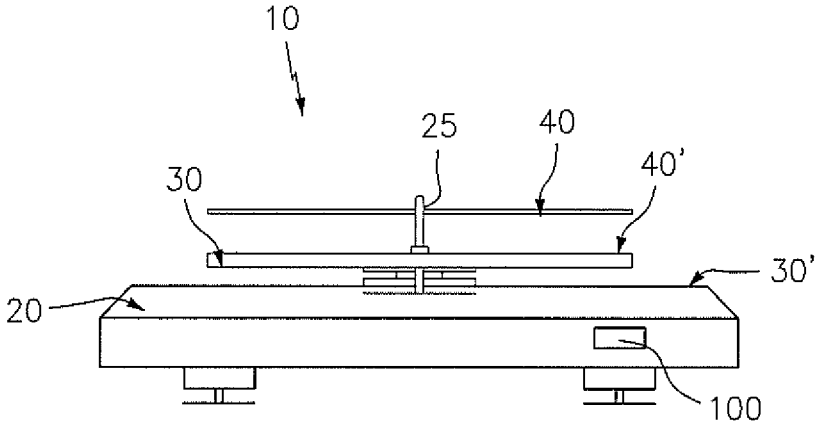
FIG. 3 is a cross sectional view of the display constructed in accordance with the preferred embodiment of FIGS. 1 and 2.
Figure 4:
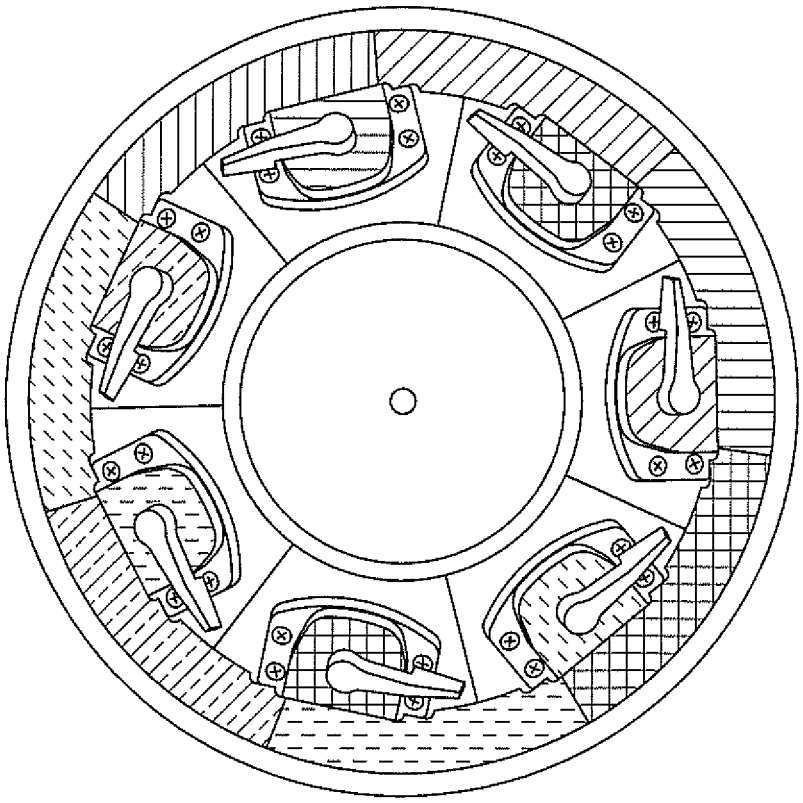
FIG. 4 (PRIOR ART)
FIG. 4 illustrates a selection wheel in the prior art that permits a user to mix/match window colors with corresponding hardware components for the window.

Reference is generally made to FIGS. 1-3, which illustrate, among other things, a display, generally indicated at 10, constructed in accordance with a first embodiment of the present invention. The display 10, and the operation thereof, generally speaking, advantageously creates one or more, and preferably a plurality, of differently configured at least substantially completed articles. Although the type or kind of article(s) is not limited hereby, the preferred article with which display 10 is ideally suited to display is a consumer article, and in particular, timepieces, and specifically wristwatches. However, those skilled in the art will appreciate that the present invention is not so limiting.

In a first preferred embodiment, the display 10 comprises a first support on which at least two of the first components are arranged; a second support, spaced apart from the first support, on which at least one second component is arranged, and wherein the first support and the second support are rotatable with respect to each other. As will now be explained in connection with various preferred specific embodiments, the two components on the first support are each separately alignable, but not simultaneously, with the component on the second support, thereby separately creating a visual impression of at least two substantially completed articles.

For example, in a first specific preferred embodiment where the articles are timepieces, each of the first components comprises one or more timepiece strap sections and the second component comprises at least a timepiece watchhead. However, in a second specific preferred embodiment, each of the first components comprises at least a timepiece watchhead and the second component comprises one or more timepiece strap sections.

In yet a further alternative embodiment, the present invention is directed to a display for creating at least two differently configured articles, each of which comprises at least a first component and at least a second component, wherein the display comprises a first support on which at least one first component is arranged; and a second support, spaced apart from the first support, on which at least two second components are arranged, and wherein the first support and the second support are rotatable with respect to each other; wherein the one component on the first support is separately alignable, but not simultaneously, with the at least two components on the second support thereby separately creating a visual impression of at least two substantially completed articles. In this embodiment, the first component may comprise the one or more timepiece strap sections and the second components comprise at least a timepiece watchhead. And in an alternative embodiment, the first component comprises at least a timepiece watchhead and the second components comprise one or more timepiece strap sections.

A base 20 may also be provided, wherein in a preferred embodiment, the first support is intermediate the base and the second support. In one embodiment, the first support is rotatable relative to the base, in another preferred embodiment, the second support may be rotatable relative to the base and yet in another alternative embodiment, both of the first and second supports are rotatable relative to the base. A motor, generally indicated at 100, may be provided and electrically and/or mechanically coupled to the first and/or second supports, namely to the one or more supports that are rotateable, to rotate the rotateable support(s).

Thus, turning now to the figures specifically, in a first embodiment, display 10 may comprise a base, generally indicated at 20. However, it should be understood that base 20 can operate as the first support without any loss of functionality of the present invention. Using base 20 as the first support can, for example, reduce the number of components needed to construct display 10. However, base 20 can provide aesthetic features to the invention and/or other functional advantages, and therefore can be incorporated into the invention, as illustrated in FIGS. 1 and 2. Thus, FIGS. 1 and 2 also illustrate a separate first support, generally indicated at 30, coupled to the base 20, upon which one or more (and preferably a plurality of) first components are arrangeable. The figures illustrate the first components $S_1$-$S_N$ so arranged.

Display 10 also comprises a second support, generally indicated at 40, also shown coupled to the base 20 and spaced apart from the first support 30 such that the first support 30 is intermediate the base 20 and the second support 40. One or more (and preferably a plurality of) second components $H_1$-$H_N$ are arrangeable on second support 40. The figures illustrate the second components so arranged.

Supports 30 and 40 are rotateably mounted on a stem 25.

Reference is briefly again made to FIG. 1 to illustrate another embodiment of display 10 that does not utilize a base, such that the first support is indicated by reference number 30' and the second support is indicated by reference number 40'. In such an embodiment, the upper support 40 shown in FIG. 3 would thus not be necessary.

In accordance with the preferred embodiment, the first support 30 and the second support 40 are rotatable with respect to each other. For example, in accordance with a specific embodiment, only first support 30 may be rotatable relative to the base 20. In accordance with another specific embodiment, only the second support 40 is rotatable relative to the base 20. Still in a further alternative, both the first support 30 and the second support 40 are rotatable relative to the base 20. The power to rotate one or both of the supports 30, 40 may simply be the use of a user's hand to rotate one or both of the supports 30, 40. Alternatively, display 10 may comprise motor 100 mechanically and/or electrically coupled to the rotatable support to rotate the first support 30 relative to the base 20, the second support 40 relative to the base 20 and/or both the first and second supports 30, 40 relative to the base 20.

In an embodiment that does not include a base, the first support 30' need not rotate, thereby providing only that the second support 40' is rotatable. However, an embodiment is also envisioned in which the display is supported from the top (e.g. suspended from an upper support (e.g. ceiling) thereby providing an incentive to allow for the lower (i.e. first) support 30 to rotate.

A preferred operation of display 10 will now be disclosed.

For example, the figures show display 10 made in accordance with the present invention comprising N first components and N second components arranged about their respective supports. As illustrated, N=12, but this is by way of example and not limitation as more and/or less first and second components are contemplated hereby. However, one skilled in the art would recognize that as N increases, a larger display 10 and more specifically, larger first and second supports 30, 40 will be needed, and therefore N≤12 is about the maximum number before the consumer could get overwhelmed with options and/or the display could get inconveniently large. Thus, in a preferred embodiment, display 10 has twelve (12) second component watchheads arranged around second support 40 and a corresponding number (i.e. twelve (12)) of first component watchstraps arranged around first support 30.

As illustrated in FIG. 2, at a point in time (i.e. t=0), first component watchstrap $S_1$ is aligned with second component watchhead $H_1$ (or could be so aligned by prior rotation of the supports with respect to each other). With such alignment of watchstrap $S_1$ with watchhead $H_1$, first component watchstrap $S_2$ is aligned with second component watchhead $H_2$, and each successive first component watchstrap $S_N$ is aligned with its corresponding second component watchhead $H_N$. Thus, the user/consumer/customer can visualize up to N differently configured at least substantially completed articles by having each of the respective first components aligned with a respective one of the second components.

At this point, reference is made to what an "at least substantially completed article(s)" is intended to mean and how this phrase should be interpreted. That is, it should be understood that with the display 10 configured as it is, it is not possible, or at least not practical, to actually mechanically connect, via a springbar or the like, the respective straps on support 30 to the watchheads on support 40. So, to create "actually completed" articles is not contemplated hereby. Moreover, it is also possible that the display straps may omit the clasp or other metal fittings on the ends thereof. Nevertheless, the alignment of the straps segments and the respective watchheads together do in fact create a visual impression of what would be a "completed article" were they mechanically connected and/or were the straps to include the metal components of the clasp, etc. Thus, for purposes of the present invention, it is sufficient that at least the watchstrap and the watchhead are provided and when aligned together as illustrated in the figures, each watchhead/strap combination does in fact create a visual impression of at least a substantially completed article. In contrast, a "completed" article would include a watchhead mechanically coupled to the strap, with the strap including the metal clasp, etc. Therefore, alignment of a watchstrap and a watchhead such that they together create what appears to be a completed wristwatch fulfils the definition and interpretation of what it means to be an "at least a substantially completed article(s)." Based on the foregoing, an "at least a substantially completed article(s)" is about 90% complete, and a wristwatch that can be visualized and perceived as being essentially complete, i.e. by having the watchstrap and watchhead aligned as illustrated in the figures and described above, meets the claim limitations set forth herein.

Figure 2A:
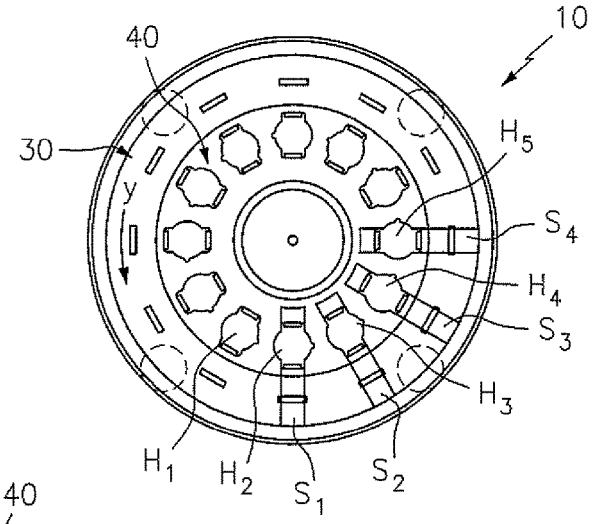
FIGS. 2A and 2B are top plan views of the display constructed in accordance with the embodiment of FIG. 1, showing a different alignment of the first and second components after relative rotation of the first and second supports with respect to each other.

Continuing with a preferred operation of the present invention, it can be seen that rotation of the first support 30 with respect to the second support 40 provides alignability of each of the respective first components with up to N-1 different ones of the second components. For example, as illustrated in FIG. 2A, rotation of (e.g.) support 30 in the "Y" direction with respect to support 40 rotates the first and second components relative to each other such that now, first component watchstrap $S_1$ is aligned with second component watchhead $H_2$, first component watchstrap $S_2$ is aligned with second component watchhead $H_3$ and so on such that first component watchstrap $S_N$ is aligned with second component watchhead $H_{N+1}$ (although it should be understood that first component watchstrap $S_{12}$ is thus aligned with second component watchhead $H_1$).

Figure 2B:
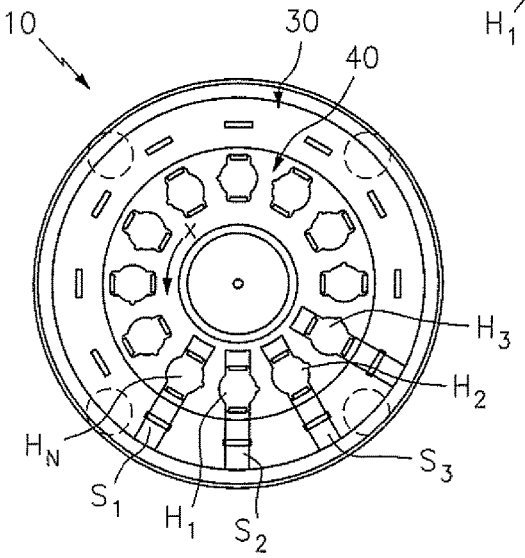

Alternatively, in a corresponding manner, from the starting point in time as illustrated in FIG. 2, if support 40 were instead to be rotated in the "X" direction with respect to support 30 as illustrated in FIG. 2B, first component watchstrap $S_1$ would then be aligned with second component watchhead $H_N$, first component watchstrap $S_2$ is aligned with second component watchhead $H_1$ and so on such that first component watchstrap $S_N$ is aligned with second component watchhead $H_{N-1}$.

Either way, it can be seen that alignment of each of the N first components with each of the N second components creates N×N differently configured at least substantially completed articles. Although not all straps are illustrated in FIGS. 2, 2A, 2B, this is simply for brevity. It should be understood that straps preferably and/or do fill each of the respective positions, as illustrated in FIG. 1.

As stated herein, each first component is preferably a timepiece wriststrap, and preferably comprises either an elongated single elongated strap extending past the 12:00 position and the 6:00 position of the watchhead or comprises two separate pieces, i.e. one extending from the 12:00 position and one from the 6:00 position of the watchhead. However, the present invention also contemplates an embodiment wherein only a single strap section is provided, i.e. extending from either the 12:00 position or the 6:00 position of the watchhead, as it is believed that the prior art does not describe or suggest a display in which any two separate components of a consumer article, such as a timepiece, are interchangeably displayed, such as disclosed herein. However, both a watchstrap in the form of one single elongated strap or in the form of two sections (i.e. to respectively connect to lugs at the 12:00 and 6:00 positions of the watchhead) are deemed to be considered a one (1) first component.

For clarity, it should also be understood that the interpretation of the first support rotating relative to the second support is not specifically calling out which one of the supports is actually rotating (e.g. relative to a stationary reference point (i.e. the base)). That is, for example, reciting that the first support rotates relative to the second support (or language similar thereto) can mean that the first support is actually rotating relative to a stationary reference point or that the second support is actually rotating relative to the stationary reference point or that both are rotating relative to the stationary reference point.

In the preferred embodiments, motor 100 can rotate either support in either direction.

It can thus be seen that the present invention provides an improved display for creating a plurality of differently configured at least substantially completed articles. As should now also be understood, the display disclosed herein is particularly suited for displaying consumer articles, and preferably timepieces such as wristwatches. As can also be seen, the relative rotation of the supports that carry the components of the article(s) creates the visual impression of at least one, and preferably at least two, substantially completed articles. Thus, the present invention provides a way for potential consumers to more easily and efficiently create a plurality of differently configured at least substantially completed consumer articles, thus improving and facilitating a shopping and/or potential purchase decision making experience. And, the present invention also provides methodologies for carrying out and/or facilitating the foregoing.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

For example, the present disclosure covers all four (4) variations wherein there could be (i) more straps on the lower support than watchheads on the upper support; (ii) more watchheads on the lower support than straps on the upper support; (iii) more watchheads on the upper support than straps on the lower support; and (iv) more watchstraps on the upper support than watchheads on the lower support. Regardless thereof, all the features disclosed herein and all the claimed features are applicable with each of these four (4) configurations.

Also, while FIG. 1 does illustrate in perspective view a specific embodiment wherein the watchheads are positioned on the support above the watchstraps and further, wherein FIGS. 2, 2A, 2B are disclosed as illustrating views related to FIG. 1, for the avoidance of doubt, it should be understood that FIGS. 2, 2A and 2B equally can be seen and understood to disclose an embodiment in which the straps are positioned above the watchheads if desired. That is, it should be interpreted that an identical set of FIGS. 2, 2A, 2B could be provided to show the alternative embodiments disclosed herein where the straps are located above the watchhead. Therefore, it should be understood that each and every embodiment disclosed herein is illustrated in the figures.

To be sure, the present invention is applicable to a wide variety of articles, and thus, while the preceding embodiments have been disclosed with reference to wristwatches, the scope of the invention is not so limiting.

What is claimed is:

1. A display for visually creating at least two differently configured timepieces, each timepiece comprising at least watchhead and a strap, wherein the display comprises:

a first support on which at least two straps are arranged;

a second support, spaced apart from the first support, on which at least one watchhead is arranged, and a stem for providing at least one support to be rotatable with respect to the other support so as to create a visual impression of at least two substantially completed timepieces;

whereby the at least two straps are each separately alignable, but not simultaneously, with the at least one watchhead on the second support.

2. The display as claimed in claim 1, comprising a base, wherein the first support is intermediate the base and the second support.

3. The display as claimed in claim 1, comprising at least two watchheads and the same number of straps and watchheads arranged about their respective supports, wherein each strap is alignable with a watchhead and wherein rotation of one support provides alignability of each strap with a different watchhead, and creates differently configured substantially completed articles.

4. The display as claimed in claim 2, wherein the first support is rotatable relative to the base.

5. The display as claimed in claim 2, wherein the second support is rotatable relative to the base.

6. The display as claimed in claim 2, comprising a motor to rotate at least one of the first and second supports relative to the base.

7. A method of creating at least two differently configured timepieces, each comprising at least a strap and a watchhead, wherein the display comprises a first support on which at least two straps are arranged, a second support, spaced apart from the first support, on which at least one watchhead is arranged, and a stem for providing at least one support to be rotatable with respect to the other support, wherein the method comprises the steps of:

aligning a first strap with the watchhead thereby creating a visual impression of at least one substantially completed timepiece; and rotating one support with respect to the other support to align a second strap with the watchhead thereby creating a visual impression of at least one different substantially completed timepiece;

whereby the straps on the first support are each separately alignable, but not simultaneously, with the watchhead on the second support.

8. The method as claimed in claim 7, wherein the display comprises the same number of straps and watchheads arranged about their respective supports, wherein the method comprises the steps of:

rotating one support with respect to the other support to align each strap with a watchhead and wherein further rotation of one support with respect to the other support aligns each strap with a different watchhead.

* * * * *